US007800691B2

(12) United States Patent
Oyaizu et al.

(10) Patent No.: US 7,800,691 B2
(45) Date of Patent: Sep. 21, 2010

(54) VIDEO SIGNAL PROCESSING APPARATUS, METHOD OF PROCESSING VIDEO SIGNAL, PROGRAM FOR PROCESSING VIDEO SIGNAL, AND RECORDING MEDIUM HAVING THE PROGRAM RECORDED THEREIN

(75) Inventors: Hideki Oyaizu, Tokyo (JP); Seiji Kobayashi, Tokyo (JP)

(73) Assignee: Sony Corporation (JP)

( * ) Notice: Subject to any disclaimer, the term of this patent is extended or adjusted under 35 U.S.C. 154(b) by 1254 days.

(21) Appl. No.: 11/353,458

(22) Filed: Feb. 14, 2006

(65) Prior Publication Data

US 2006/0197732 A1 Sep. 7, 2006

(30) Foreign Application Priority Data

Feb. 14, 2005 (JP) ..... P2005-036044

(51) Int. Cl.

| | |
|---|---|
| ***H04N 11/20*** | (2006.01) |
| ***H04N 7/00*** | (2006.01) |
| ***H04N 7/01*** | (2006.01) |
| ***H04N 5/00*** | (2006.01) |
| ***H04N 3/14*** | (2006.01) |
| ***G09G 3/36*** | (2006.01) |
| ***G09G 5/02*** | (2006.01) |

(52) U.S. Cl. ..... 348/441; 348/447; 348/497; 348/790; 348/607; 345/88; 345/89; 345/596

(58) Field of Classification Search ..... 348/441, 348/790, 497, 607, 447; 345/88, 89, 596
See application file for complete search history.

(56) References Cited

U.S. PATENT DOCUMENTS 5,583,530 A * 12/1996 Mano et al. ..... 345/89
5,638,091 A * 6/1997 Sarrasin ..... 345/692
6,088,012 A * 7/2000 Shigeta et al. ..... 345/63
6,496,194 B1 * 12/2002 Mikoshiba et al. ..... 345/596
6,825,835 B2 * 11/2004 Sano et al. ..... 345/204

(Continued)

FOREIGN PATENT DOCUMENTS

JP 05-068221 A 3/1993

(Continued)

OTHER PUBLICATIONS

Office Action from Japanese Application No. 2005-036044, dated Mar. 2, 2010, No translation.

*Primary Examiner*—Brian P Yenke
(74) *Attorney, Agent, or Firm*—Lerner, David, Littenberg, Krumholz & Mentlik, LLP

(57) ABSTRACT

A video signal processing apparatus generates a plurality of subframes from each frame of an input video signal to generate an output video signal having a frame frequency higher than the frame frequency of the input video signal. The output video signal also has a smaller number of tones than the number of tones of the input video signal. The pixel values of pixels corresponding to the plurality of subframes are set in accordance with the input video signal to represent halftones that are difficult to display with the number of the tones of the output video signal. The pixel values of the pixels corresponding to the plurality of subframes are set to yield a maximum distribution of the pixel values in a time axis direction.

10 Claims, 18 Drawing Sheets

U.S. PATENT DOCUMENTS

| | | | | |
|---|---|---|---|---|
| 6,961,037 | B2 * | 11/2005 | Kuwata et al. | 345/88 |
| 7,227,581 | B2 * | 6/2007 | Correa et al. | 348/447 |
| 7,483,084 | B2 * | 1/2009 | Kawamura et al. | 348/687 |
| 2002/0044122 | A1 * | 4/2002 | Kuwata et al. | 345/88 |
| 2002/0135595 | A1 * | 9/2002 | Morita et al. | 345/589 |
| 2003/0222840 | A1 * | 12/2003 | Koga et al. | 345/89 |
| 2004/0130560 | A1 * | 7/2004 | Matsueda et al. | 345/692 |
| 2004/0257325 | A1 * | 12/2004 | Inoue | 345/89 |

FOREIGN PATENT DOCUMENTS

| | | | |
|---|---|---|---|
| JP | 06-222740 | A | 8/1994 |
| JP | 07-294881 | A | 11/1995 |
| JP | 3158904 | B2 | 5/1996 |
| JP | 2000-029442 | A | 1/2000 |
| JP | 2004-240317 | A | 8/2004 |
| JP | 2004-302270 | A | 10/2004 |
| JP | 2005-173573 | A | 6/2005 |

* cited by examiner

FIG. 10

| | RGB | HSV | ABSOLUTE VALUE OF DIFFERENCE IN H |
|---|---|---|---|
| $f_0$ | (10,30,98) | (3.95,0.898,0.383) | |
| FIRST EMBODIMENT | (10,30,63) | (3.79,0.841,0.246) | 0.16 |
| | ( 0, 0,35) | (4.19, 1.00 ,0.137) | 0.24 |
| | ( 0, 0, 0) | (0 ,0 ,0 ) | |
| | ( 0, 0, 0) | (0 ,0 ,0 ) | |
| SECOND EMBODIMENT | ( 6,19,63) | (3.95,0.905,0.246) | 0.00 |
| | ( 4,11,35) | (3.95, 1.00 ,0.137) | 0.00 |
| | ( 0, 0, 0) | (0 ,0 ,0 ) | |
| | ( 0, 0, 0) | (0 ,0 ,0 ) | |

FIG. 14

| | 1 FRAME | 2 FRAME | 3 FRAME | 4 FRAME | AVERAGE |
|---|---|---|---|---|---|
| PIXEL VALUE | 11 | 11 | 11 | 10 | 10.75 |
| b3 | 1 | 1 | 1 | 1 | |
| b2 | 0 | 0 | 0 | 0 | |
| b1 | 1 | 1 | 1 | 1 | |
| b0 | 1 | 1 | 1 | 0 | |

VIDEO SIGNAL PROCESSING APPARATUS, METHOD OF PROCESSING VIDEO SIGNAL, PROGRAM FOR PROCESSING VIDEO SIGNAL, AND RECORDING MEDIUM HAVING THE PROGRAM RECORDED THEREIN

CROSS-REFERENCE TO RELATED APPLICATIONS

The present application claims priority from Japanese Patent Application No. JP 2005-036044 filed on Feb. 14, 2005, the disclosure of which is hereby incorporated by reference herein.

BACKGROUND OF THE INVENTION

The present invention relates to a video signal processing apparatus, a method of processing a video signal, a program for processing a video signal, and a recording medium having the program recorded therein and is applicable to a case where a motion picture is displayed in, for example, a liquid crystal display (LCD) panel. The present invention is directed to reduce motion blur by setting the pixel values of subframes such that the maximum distribution of the pixel values in a time axis direction is yielded, when one frame is displayed by using multiple subframes to represent halftones by frame rate control (FRC).

An increasing number of display devices use so-called flat panel displays (FPDs) including LCD panels, plasma display panels (PDPs), and organic electroluminescenct (EL) display panels, instead of cathode ray tubes, in recent years. Since the display devices using the LCD panels, among the display devices using the FPDs, have a smaller number of displayable tones, compared with the display devices using the cathode ray tubes, a dither method, frame rate control (FRC), and so on, which represent pseudo halftones to compensate the number of tones that is sufficient, are proposed.

The dither method represents halftones by the use of an area integration effect of the eyes of a human being. In the dither method, the pixel value of each pixel in each unit including multiple pixels is controlled to represent a halftone for every unit.

In contrast, the FRC represents the halftones by the use of a time integration effect of the eyes of a human being. In the FRC, the tones are switched for every frame to represent the halftones.

In the FRC in the past, when the pixel value of a halftone to be represented is equal to "I0", the occurrence rate of displayable pixel values "I1" and "I2" before and after the pixel value "I0" is set to the rate according to the pixel value "I0" of the halftone, to represent the pixel value "I0" of the halftone.

For example, as shown in FIG. 14, when each tone is represented by using six bits in a display device capable of displaying each tone by using four bits, the occurrence rate of the displayable pixel values "I1" and "I2" is set to the rate according to the pixel value "I0" of the halftone in units of continuous four frames corresponding to the difference between the numbers of bits. Specifically, in the representation of the tone of a pixel value "10.75" under this condition, the three frames, among the continuous four frames, are represented with a pixel value "11" and the remaining one frame is represented with a pixel value "10".

In the following examples including the example in FIG. 14, the brightness of each pixel is represented by a pixel value with respect to the brightest pixel value, among the pixel values represented by the tone values. For example, as shown in FIG. 14, the brightest pixel value is represented by "15" in the display of 16 tones by using four bits. As shown in FIG. 15, the brightest pixel value is represented by "255" in the display of 256 tones by using eight bits, and the brightest pixel value is represented by "63" in the display of 64 tones by using six bits. These brightest pixel values may be displayed along with the pixel values indicating the brightness of the pixels, if required.

The display of the halftones by the FRC has a disadvantage of a flicker that is highly visible. In order to resolve such a problem, for example, the Japanese Examined Patent Application Publication No. 7-89265 discloses a technique for making the flicker indistinctive by using the FRC with the dither method.

In recent years, display panels having higher response speeds in, for example, an optical compensated birefringence (OCB) mode have been developed. Methods of displaying one frame by using multiple subframes in a display panel having a higher response speed to represent the halftones by the FRC are also proposed. According to Bloch's law, since it is difficult for the eyes of a human being to recognize a variation in light incident over a predetermined time period, the eyes of the human being recognize only the integrated value of light incident over the predetermined time period. Accordingly, increasing the frame frequency and representing the halftones by the FRC allow the flicker to be made indistinctive.

Specifically, in order to display a video signal S1 with 256 tones in a display panel that can display only up to 64 tones, one frame of the video signal S1 is displayed by using four subframes, as shown by arrows in FIG. 15, to display the video image corresponding to the video signal S1 by using a video signal S2 having the frame frequency four times higher than that of the video signal S1. In addition, the pixel value of each pixel in the four subframes is set to the displayable pixel value "I1" or "I2" before or after the pixel value "I0" of the halftone corresponding to the original video signal S1, and the occurrence rate of the pixel value "I1" and "I2" in the four subframes is set to the rate according to the pixel value "I0" of the halftone corresponding to the original video signal S1. As a result, when the pixel value of the original video signal S1 is, for example, "98/255", the pixels corresponding to the four subframes can be represented by pixel values "24", "25", "24", and "25" to make the flicker indistinctive and to represent the halftone by a pixel value "24.5/63 (98/255)", which is the average of the pixel values of the tones of the four subframes.

In a hold-type display device, such as the LCD panel, the same image is continued to be displayed during one frame. Accordingly, when a human being follows an object that is moving with his eye, the position where an image of the object is formed (hereinafter referred to as an image forming position) vibrates on the retina. As a result, the image of the moving object is blurred to cause so-called motion blur. This vibration is caused by repetition of an operation in which, after the image forming position is shifted in a direction opposite to the moving direction of the object during one frame, the position instantaneously returns to the original image forming position.

Such motion blur does not occur in impulse-type display devices, such as the cathode ray tube. Accordingly, techniques for approximating the display characteristics of the LCD devices to those of the impulse-type display devices by driving the LCD panel or by backlight control are proposed in order to reduce the motion blur.

The techniques adopting the drive of the LCD panel is called black insertion in which fully black subframes are inserted between frames. Although these techniques can prevent the motion blur, there is a problem of reduction in the brightness. In contrast, the techniques adopting the backlight control achieve an effect similar to that of the black insertion by intermittently turning on the backlight.

There are cases in which motion pictures are displayed in the display devices described above. FIG. 16 shows a display image of an object 1 that is moving from left to right, as shown by an arrow. The motion of an edge of the moving object 1 is represented by continuous frames, as shown by reference letters and numerals F1 and F2, which denote enlarged continuous frames.

As shown in FIG. 17 in contrast to FIG. 15, when one frame is displayed by using the multiple subframes to represent the halftones by the FRC, the motion of the edge of the moving object 1 is intermittently represented by using the four subframes. When a human being follows the moving object 1 with his eye, as shown in FIG. 18A, the position where an image of the moving object 1 is formed vibrates on the retina every four frames, as shown in FIG. 18B. As a result, the motion blur is also disadvantageously caused.

The vibration of the image forming position of the moving object 1 on the retina due to the motion blur is caused by repetition of an operation in which, after the image forming position of the moving object 1 is shifted stepwise in a direction opposite to the moving direction of the moving object 1 by a distance corresponding to the multiple subframes allocated to one frame, the position instantaneously returns to the original image forming position. Referring to FIG. 18B, when the subframes are displayed under the condition described above with reference to FIG. 17, the pixel values on the retina are represented by the tones of the original video signal S1.

In order to resolve the above problems, a method of generating these subframes by frame interpolation using motion vectors is disclosed in, for example, Japanese Patent No. 3158904. However, the frame interpolation using the motion vectors causes a problem in that the structure of the display device becomes complicated. Furthermore, it may be impossible to completely prevent the motion vectors from being incorrectly detected. If the motion vectors are incorrectly detected, the motion blur is increased to display a significantly unnatural image.

SUMMARY OF THE INVENTION

It is desirable to provide a video signal processing apparatus, a method of processing a video signal, a program for processing a video signal, and a recording medium having the program recorded therein, which are capable of reducing motion blur when each frame is displayed using multiple subframes to represent halftones by FRC.

According to an embodiment of the present invention, a video signal processing apparatus includes a video signal storage unit operable to store an input video signal having a frame frequency and a number of tones; and a generating unit operable to generate a plurality of subframes from each frame of the input video signal to generate an output video signal having a frame frequency higher than the frame frequency of the input video signal and a number of tones less than the number of tones of the input video signal. The pixel values of pixels corresponding to the plurality of subframes are set in accordance with the input video signal to represent halftones that are difficult to display with the number of the tones of the output video signal. The pixel values of the pixels corresponding to the plurality of subframes are set to yield a maximum distribution of the pixel values in a time axis direction.

According to another embodiment of the present invention, a video signal processing method includes receiving an input video signal having a frame frequency and a number of tones; generating a plurality of subframes from each frame of the input video signal to generate an output video signal having a frame frequency higher than the frame frequency of the input video signal and a number of tones less than the number of tones of the input video signal; and setting the pixel values of pixels corresponding to the plurality of subframes in accordance with the input video signal to represent halftones that are difficult to display with the number of the tones of the output video signal. The pixel values of the pixels corresponding to the plurality of subframes are set to yield a maximum distribution of the pixel values in a time axis direction.

According to yet another embodiment of the present invention, a video signal processing program causes an arithmetic processor to perform a predetermined process, the process including receiving an input video signal having a frame frequency and a number of tones; generating a plurality of subframes from each frame of the input video signal to generate an output video signal having a frame frequency higher than the frame frequency of the input video signal and a number of tones less than the number of tones of the input video signal; and setting the pixel values of pixels corresponding to the plurality of subframes in accordance with the input video signal to represent halftones that are difficult to display with the number of the tones of the output video signal. The pixel values of the pixels corresponding to the plurality of subframes are set to yield a maximum distribution of the pixel values in a time axis direction.

According to a further embodiment of the present invention, a recording medium is recorded with a video signal processing program that causes an arithmetic processor to perform a predetermined process, the process including receiving an input video signal having a frame frequency and a number of tones; generating a plurality of subframes from each frame of the input video signal to generate an output video signal having a frame frequency higher than the frame frequency of the input video signal and a number of tones less than the number of tones of the input video signal; and setting the pixel values of pixels corresponding to the plurality of subframes in accordance with the input video signal to represent halftones that are difficult to display with the number of the tones of the output video signal. The pixel values of the pixels corresponding to the plurality of subframes are set to yield a maximum distribution of the pixel values in a time axis direction.

In the video signal processing apparatus that generates a plurality of subframes from each frame of an input video signal to generate an output video signal having a frame frequency higher than the frame frequency of the input video signal, according to the embodiments of the present invention, the output video signal has a smaller number of tones than the number of tones of the input video signal, the pixel values of pixels corresponding to the plurality of subframes are set in accordance with the input video signal to represent halftones that are difficult to display with the number of the tones of the output video signal, and the pixel values of the pixels corresponding to the plurality of subframes are set to yield the maximum distribution of the pixel values in a time axis direction. With this video signal processing apparatus, each frame is displayed using the multiple subframes to represent the halftones by the FRC, so that the display characteristics can be approximated to impulse response to reduce the motion blur.

According to the other embodiments of the present invention, it is possible to provide a method of processing a video signal, a program for processing a video signal, and a recording medium recorded with the program for processing a video signal, which are capable of reducing the motion blur when each frame is displayed using the multiple subframes to represent the halftones by the FRC.

According to the present invention, it is possible to reduce the motion blur when each frame is displayed using the multiple subframes to represent the halftones by the FRC.

BRIEF DESCRIPTION OF THE DRAWINGS

FIG. 10 is a table showing the results of the processes according to the first and second embodiments of the present invention;

FIG. 14 is a table illustrating the representation of halftones;

DETAILED DESCRIPTION

Embodiments of the present invention will be described with reference to the attached drawings.

First Embodiment

Structure

Figure 2:
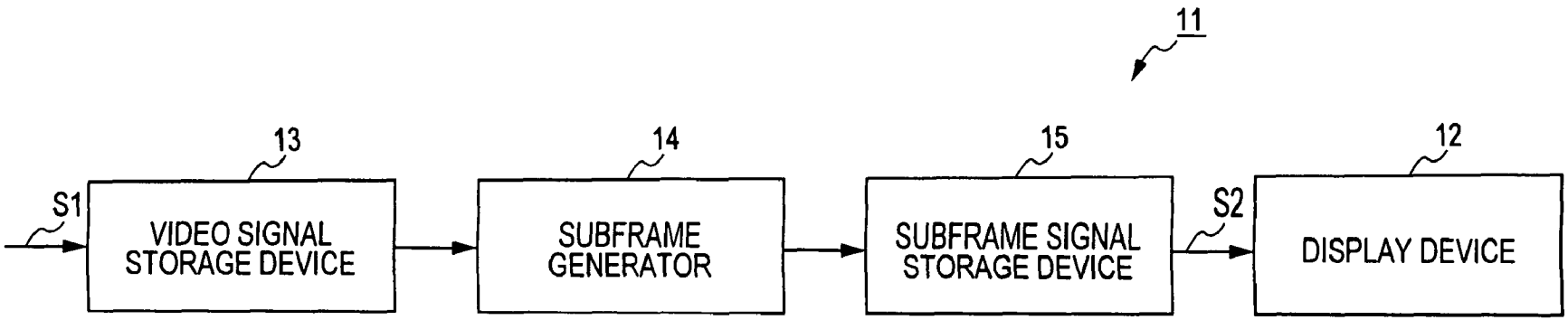
FIG. 2 is a block diagram showing an example of the structure of the video signal processing apparatus according to the first embodiment of the present invention.

FIG. 2 is a block diagram showing an example of the structure of a video signal processing apparatus 11 according to a first embodiment of the present invention. The video signal processing apparatus 11 receives a video signal S1 to display a video image corresponding to the input video signal S1 in a display device 12 that is integrated with the video signal processing apparatus 11 or that is separated from the video signal processing apparatus 11 and is connected via a cable.

The display device 12 is a LCD device that has a smaller number of displayable tones, compared with the number of tones of the input video signal S1, and that has a higher response speed in, for example, the OCB mode. The video signal processing apparatus 11 converts the input video signal S1, which has a high frame frequency that makes a flicker invisible, for example, a frame frequency of 60 Hz and which includes chrominance signals in an eight-bit parallel format, into an output video signal S2, which has a frame frequency of 240 Hz and which includes chrominance signals in a six-bit parallel format, and supplies the output video signal S2 to the display device 12. The video signal processing apparatus 11 displays one frame of the input video signal S1 by using multiple subframes to represent halftones that are difficult to be displayed in the display device 12 by the FRC. The input video signal S1 having a frame frequency of 60 Hz is a high-quality video signal corresponding to a video signal in National Television Standards Committee (NTSC) format. The input video signal S1 is generated by, for example, converting a video signal in the NTSC format into a video signal in a non-interlace format.

Referring to FIG. 2, a video signal storage device 13 in the video signal processing apparatus 11 sequentially records and stores the input video signal S1 and outputs the stored input video signal S1 under the control of a subframe generator 14.

The subframe generator 14 is, for example, an arithmetic circuit. The subframe generator 14 executes a predetermined processing program to sequentially read out and process the input video signal S1 stored in the video signal storage device 13 in order to generate and output a video signal for the subframe of the output video signal S2. Although the processing program is installed in advance in the first embodiment, the processing program may be downloaded over a network, such as the Internet, or may be provided from a recording medium having the processing program recorded therein, instead of being installed in advance. The recording medium may be any of various recording media including an optical disk, a magnetic disk, and a memory card.

A subframe signal storage device 15 in the video signal processing apparatus 11 sequentially records the video signal for the subframe generated in the subframe generator 14 and reads out the recorded video signal to supply the output video signal S2 to the display device 12.

Figure 3:
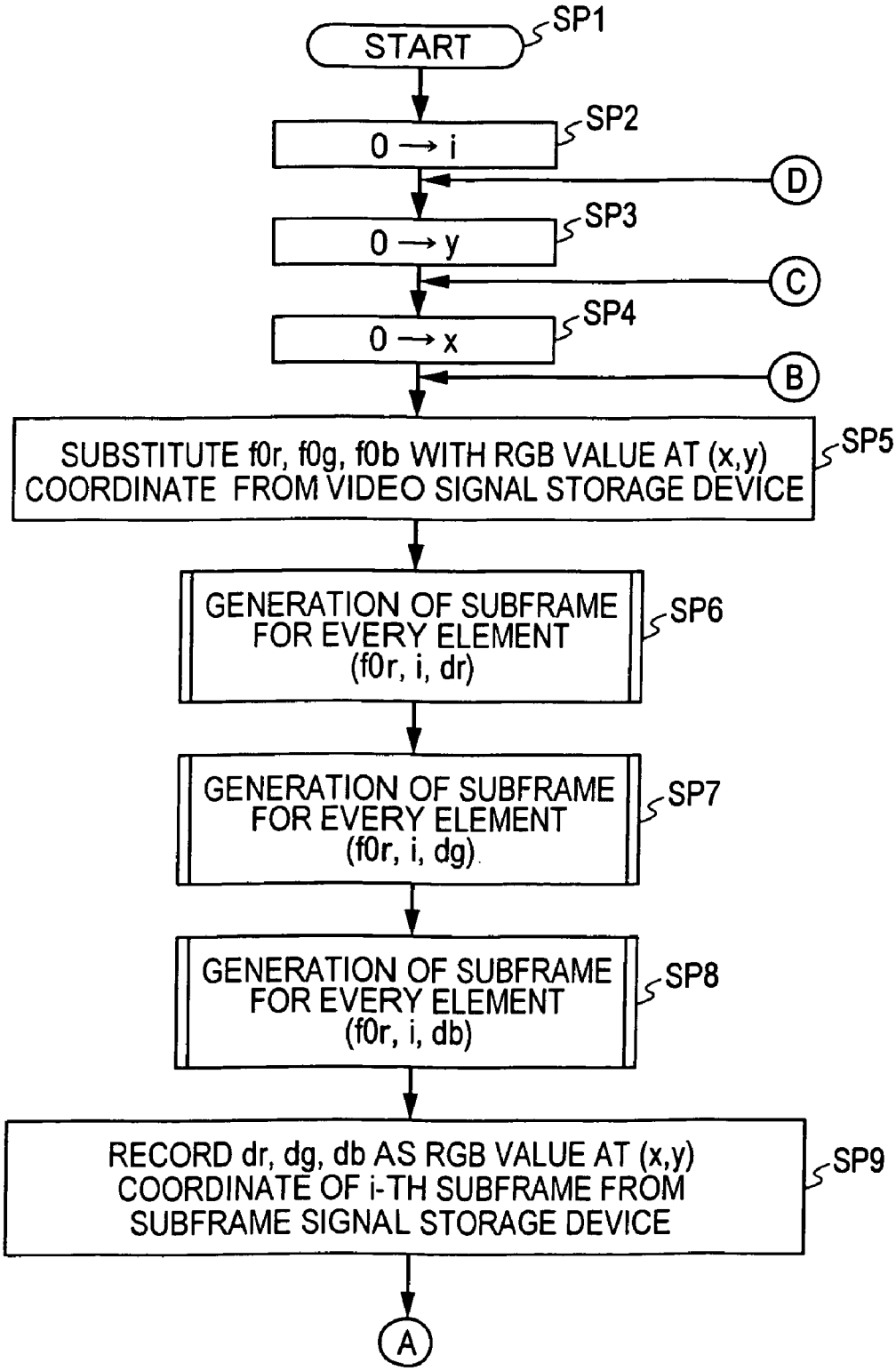
FIG. 3 is a flowchart showing a process in the subframe generator in the video signal processing apparatus in FIG. 2.
Figure 4:
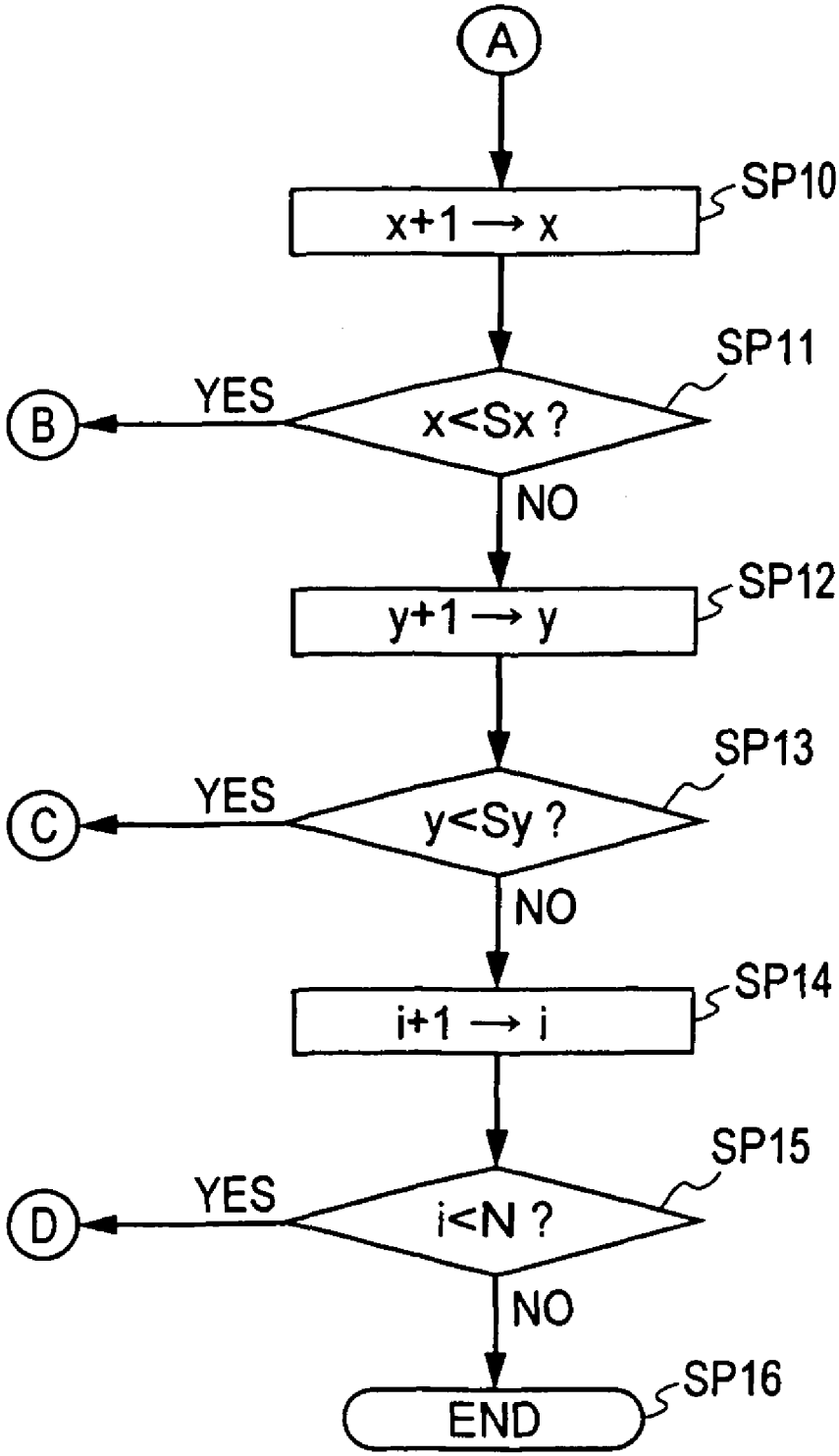
FIG. 4 is a flowchart continuing the flowchart in FIG. 3.

FIGS. 3 and 4 show a flowchart showing a process in the subframe generator 14. The subframe generator 14 performs the process in FIGS. 3 and 4 for every frame of the input video signal S1 to generate four subframes from one frame of the input video signal S1. Specifically, in Step SP1 in FIG. 3, the subframe generator 14 starts the process. In Step SP2, the subframe generator 14 initializes a variable i indicating the order of the subframe to zero. In Step SP3, the subframe generator 14 initializes a variable y indicating the vertical position of the subframe to zero. In Step SP4, the subframe generator 14 initializes a variable x indicating the horizontal position of the subframe to zero.

The subframe generator 14 sets a pixel value for the pixel at the coordinate of the variables x and y while incrementing the variables x and y to generate a video signal for the subframe. After the generation of the video signal for one subframe is completed, the subframe generator 14 increments the variable i and repeats a similar process to generate the video signal for the continuous subframe.

Specifically, in Step SP5, the subframe generator 14 acquires image data at the coordinate (x, y), corresponding to the input video signal S1 recorded in the video signal storage device 13, and sets the RGB values of the image data as a pixel value ($d_{0,r}$, $d_{0,g}$, $d_{0,b}$) at the coordinate (x,y)

In Steps SP6, SP7, and SP8, the subframe generator 14 performs generation of the subframes for every element, described below, to sequentially set pixel values for the elements of the pixel corresponding to the subframe identified by the variable i on the basis of the pixel value ($d_{0,r}$, $d_{0,g}$, $d_{0,b}$) set in Step SP5. The pixel values set for the elements in Steps SP6, SP7, and SP8 are the pixel values of red, green, and blue.

In Step SP9, the subframe generator 14 records the pixel values $d_r$, $d_g$, and $d_b$ of the elements, set in Steps SP6, SP7, and SP8, in the subframe signal storage device 15 as the image data at the coordinate (x,y) of the subframe.

In Step SP10 in FIG. 4, the subframe generator 14 increments the variable x. In Step SP11, the subframe generator 14 determines whether the variable x is smaller than an upper limit Sx in the horizontal direction. If the determination is affirmative, the subframe generator 14 goes back to Step SP5. If the determination is negative in Step SP11, then in Step SP12, the subframe generator 14 increments the variable y. In Step SP13, the subframe generator 14 determines whether the variable y is smaller than an upper limit Sy in the vertical direction. If the determination is affirmative, the subframe generator 14 goes back to Step SP4. If the determination is negative in Step SP13, the subframe generator 14 proceeds from Step SP13 to SP 14 to sequentially set the pixel value for one subframe in the order of raster scanning.

In Step SP14, the subframe generator 14 increments the variable i. In Step SP15, the subframe generator 14 determines whether the variable i is smaller than the number N of subframes generated from one frame of the input video signal S1. If the determination is affirmative, the subframe generator 14 goes back to Step SP3 and repeats a similar process for the subsequent subframe. If the determination is negative in Step SP15, the subframe generator 14 proceeds from Step SP15 to SP16 to terminate the process.

In the manner described above, the subframe generator 14 sequentially sets the pixel value for each subframe in accordance with the input video signal S1 to sequentially generate the video signal for the subframe.

In the setting of the pixel value for each subframe, the subframe generator 14 sets the pixel value for each subframe such that the maximum distribution of the pixel values in the time axis direction is yielded in the multiple subframes corresponding to one frame of the input video signal S1 in order to reduce motion blur.

The subframe generator 14 sequentially sets a maximum pixel value displayable in the display device 12, within the pixel value corresponding to the input video signal S1, for the multiple continuous subframes corresponding to one frame of the input video signal S1.

According to the first embodiment of the present invention, the pixel values are sequentially set for the multiple subframes corresponding to one frame of the input video signal S1 from the first subframe. The subframe rising to the maximum displayable pixel value, among the multiple subframes corresponding to one frame of the input video signal S1, is set so as to shift from the first subframe to the last subframe, that is, is set in so-called left justification, in accordance with the pixel value of the input video signal S1, to set the pixel values for the subframes such that the maximum distribution of the pixel values in the time axis direction is yielded.

Figures 1A, 1B:
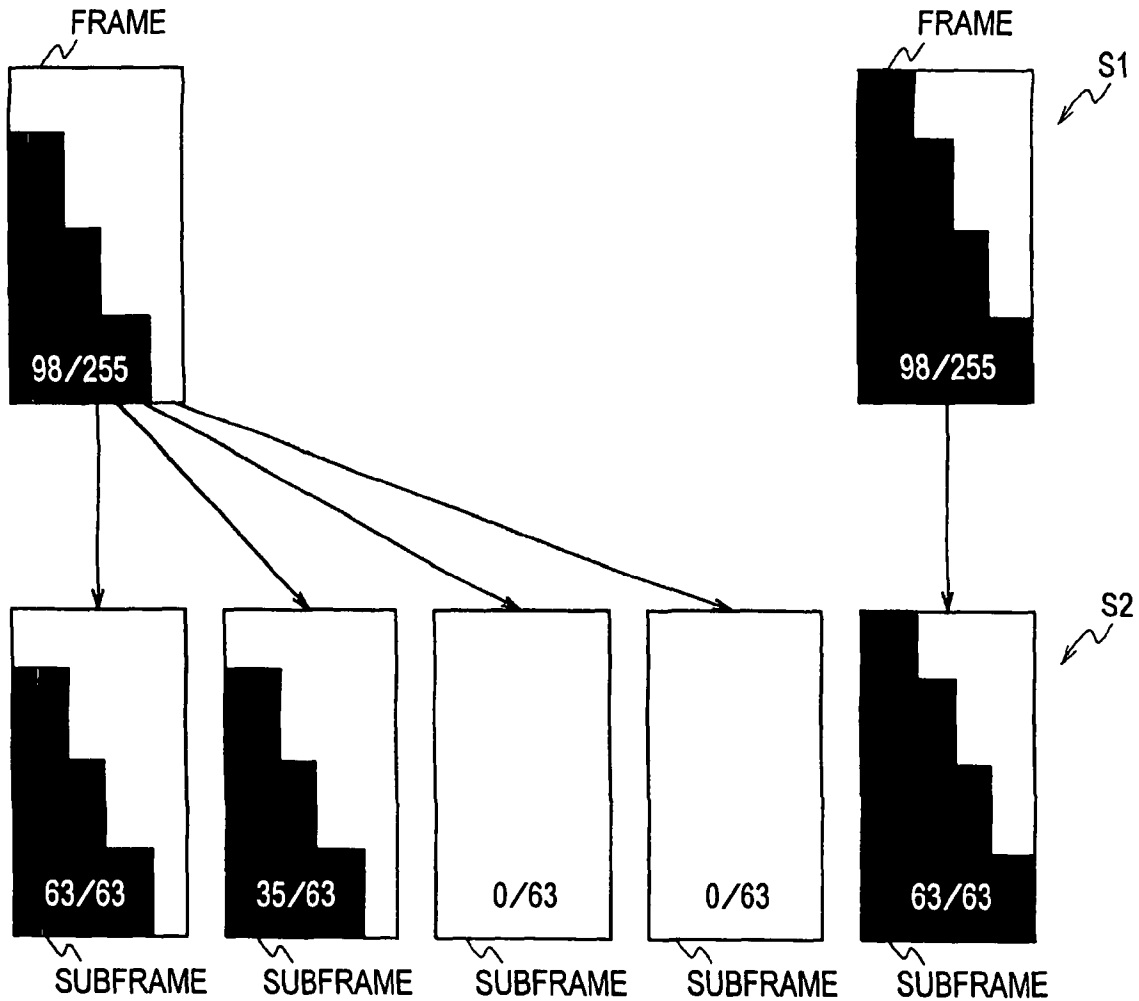
FIGS. 1A and 1B illustrate a process in a subframe generator in a video signal processing apparatus according to a first embodiment of the present invention.
Figures 17A, 17B:
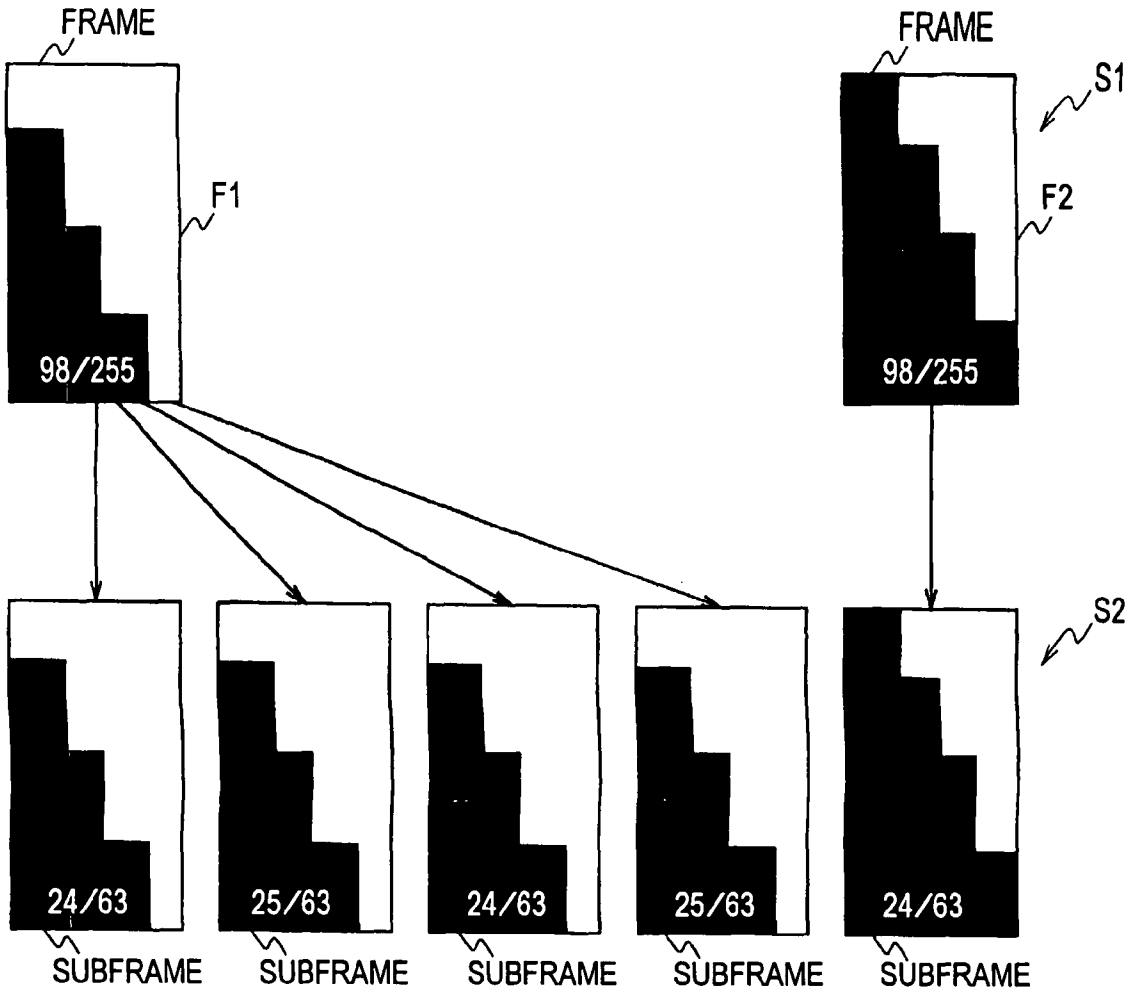
FIGS. 17A and 17B illustrate motion blur in the example shown in FIG. 16.

As shown in FIG. 1 in contrast to FIG. 17, the subframe generator 14 sets the pixel value of the first subframe to a maximum pixel value "63" displayable in the display device 12 when the pixel value of the input video signal S1 is "98". If the pixel value of the subsequent subframe is set to the maximum pixel value "63" displayable in the display device 12, the pixel value corresponding to the input video signal S1 is exceeded because the pixel value of the proximate subframe is set to the maximum value "63". Accordingly, the subframe generator 14 sets the pixel value of the subsequent subframe to the difference value "35" between the pixel value "98" and the pixel value "63".

The subframe generator 14 sets the pixel values of subframes subsequent to the subframe having the pixel value "35" to zero because the pixel values of the preceding two subframes are set to "63" and "35". The subframe generator 14 sets the pixel values such that the display characteristics of the display device 12 are approximated to impulse response in order to reduce the motion blur.

Figure 5B:
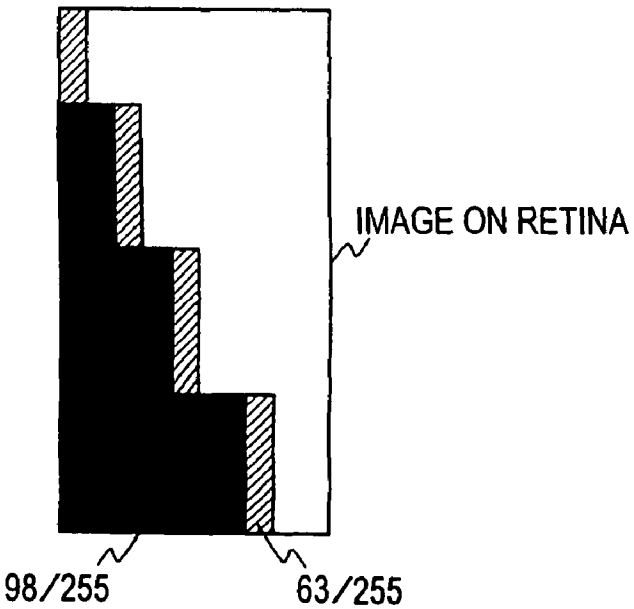
FIGS. 5A and 5B illustrate the result of the process in FIGS. 1A and 1B.
Figure 5A:
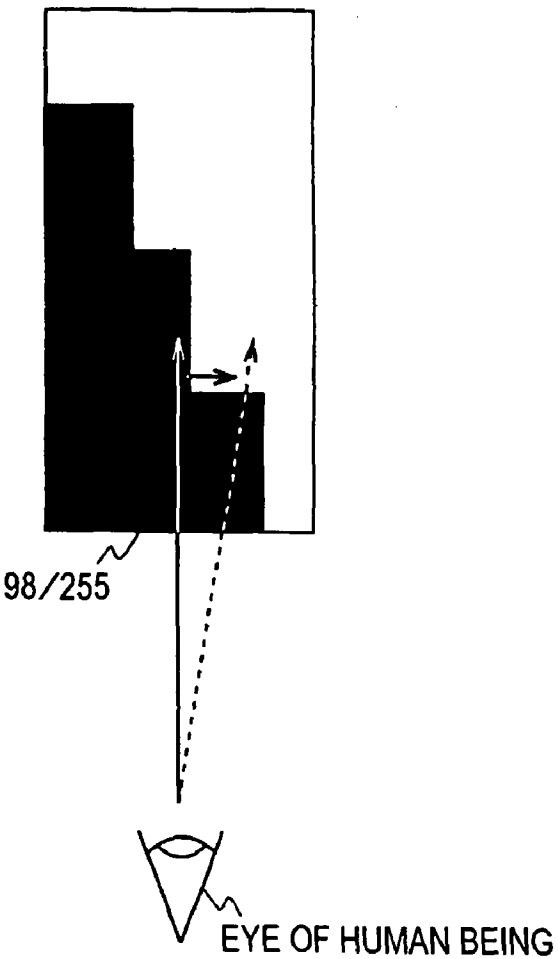

As shown in FIG. 5 in contrast to FIG. 18, in an image of a moving object, formed on the retina when a human being follows the moving object with his eye, the blur in the edge can be reduced, compared with the case where the displayable pixel value before or after the pixel value of the halftone is set, described above with reference to FIG. 18, thus reducing the motion blur.

The subframe generator 14 sequentially sets the pixel values for the subframes from the first subframe, as shown in FIG. 1, each time the subframe generator 14 repeats Steps SP6, SP7, and SP8 described above with reference to FIGS. 3 and 4.

Figure 6:
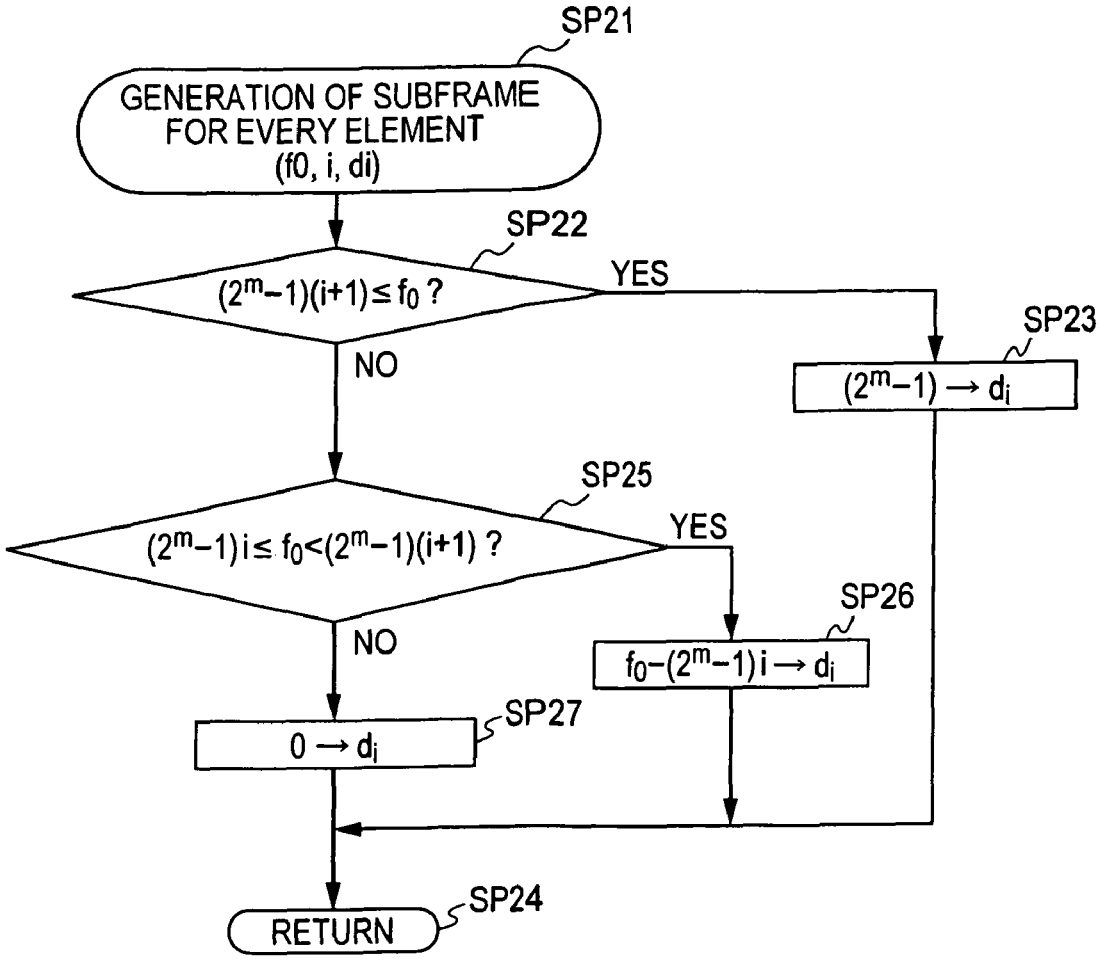
FIG. 6 is a flowchart showing in detail a subprocess of setting a pixel value in the process shown in FIGS. 3 and 4.

FIG. 6 is a flowchart showing a subprocess of setting the pixel values, performed in the subframe generator 14. The subframe generator 14 performs the subprocess in FIG. 6 in Steps SP6, SP7, and SP8 described above with reference to FIGS. 3 and 4.

Referring to FIG. 6, in Step SP21, the subframe generator 14 starts the generation of the subframe for every element and proceeds to Step SP22. The pixel value of the input video signal S1, set as the RGB value, at the coordinate (x,y) is represented by a pixel vector $f_0(x,y)=(f_{0,r}(x,y), f_{0,g}(x,y), f_{0,b}(x,y))$, and the pixel value at a coordinate corresponding to the i-th subframe is represented by a pixel vector $d_i(x,y)=(d_{i,r}(x,y), d_{i,g}(x,y), d_{i,b}(x,y))$.

In Step SP22, the subframe generator 14 determines whether a relational expression $(2^m-1)(i+1) \leqq f_0$ is established for an element to be processed, where m denotes the number of bits in the output video signal S2, corresponding to the tones displayable in the display device 12. When the pixel value of the subframe identified by the variable i is set to the maximum displayable pixel value, the subframe generator 14 determines whether the sum of the pixel values set for the subframes exceeds the pixel value $f_0$ of the pixel corresponding to the input video signal S1.

If the above relational expression is established in Step SP22, then in Step SP23, the subframe generator 14 sets the pixel value of the i-th subframe to the maximum displayable pixel value and, in Step SP24, the subframe generator 14 terminates the subprocess.

If the above relational expression is not established in Step SP22, then in Step SP25, the subframe generator 14 determines whether a relational expression $(2^m-1)i \leqq f_0 < (2^m-1)(i+1)$ is established. Specifically, the subframe generator 14 determines whether the sum of the pixel values set for the subframes does not exceed the pixel value $f_0$ of the pixel corresponding to the input video signal S1 when the pixel values of the preceding subframes are set to the maximum displayable pixel value and whether the sum of the pixel values set for the subframes exceeds the pixel value $f_0$ of the pixel corresponding to the input video signal S1 when the pixel values of the subframe identified by the variable i and of the subframes preceding the subframe identified by the variable i are set to the maximum displayable pixel value.

If the above relational expression is established in Step SP25, then in Step SP26, the subframe generator 14 sets the pixel values remaining after the pixel values of the preceding subframes are set to the maximum displayable pixel value to the pixel value of the i-th subframe and, in Step SP24, the subframe generator 14 terminates the subprocess.

If the above relational expression is not established in Step SP25, then in Step SP27, the subframe generator 14 sets the pixel value of the subframe to zero and, in Step SP24, the subframe generator 14 terminates the subprocess.

The subframe generator 14 sets the pixel values of the subframes according to Expression (1).

[Formula 1]

$$d_i(x, y) = \begin{cases} (2^m - 1) & (2^m - 1)(i+1) \le f_0(x, y) \\ f_0(x, y) - (2^m - 1)i & (2^m - 1)i \le f_0(x, y) < (2^m - 1)(i+1) \\ 0 & f_0(x, y) < (2^m - 1)i \end{cases} \quad (1)$$

Operation

In the video signal processing apparatus 11 in FIG. 2, having the structure described above, the input video signal S1 to be displayed is input in the subframe generator 14 through the video signal storage device 13, the input video signal S1 is converted into the output video signal S2 in the subframe generator 14, the converted output video signal S2 is supplied to the display device 12 through the subframe signal storage device 15, and a video image corresponding to the input video signal S1 is displayed in the display device 12.

In the conversion from the input video signal S1 into the output video signal S2 and the display of the output video signal S2, the video signal processing apparatus 11 receives the input video signal S1, which has a frame frequency of 60 Hz and includes the chrominance signals in the eight-bit parallel format, the subframe generator 14 converts the input video signal S1 into the output video signal S2, which has a frame frequency of 240 Hz and includes the chrominance signals in the six-bit parallel format, and the display device 12 capable of displaying the tones by using six bits displays the output video signal S2.

In the processing in the subframe generator 14, the four subframes are generated from one frame of the input video signal S1 and the continuous subframes form the output video signal S2. In the generation of the four subframes from one frame, the pixel values of the four subframes are set in accordance with the pixel value of the pixel corresponding to the input video signal S1. The display device 12 displays one frame of the input video signal S1 by using the multiple subframes to represent the halftones by the FRC.

Figure 18B:
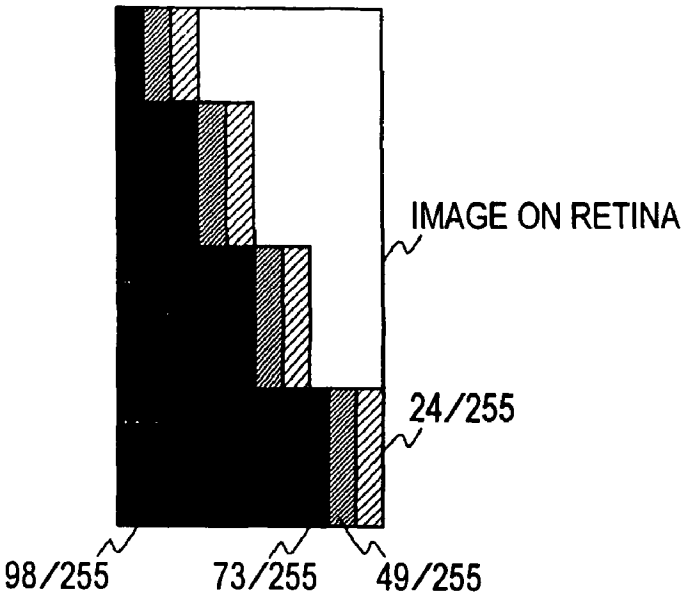
FIGS. 18A and 18B illustrate an image on a retina in the example shown in FIG. 16.
Figure 18A:
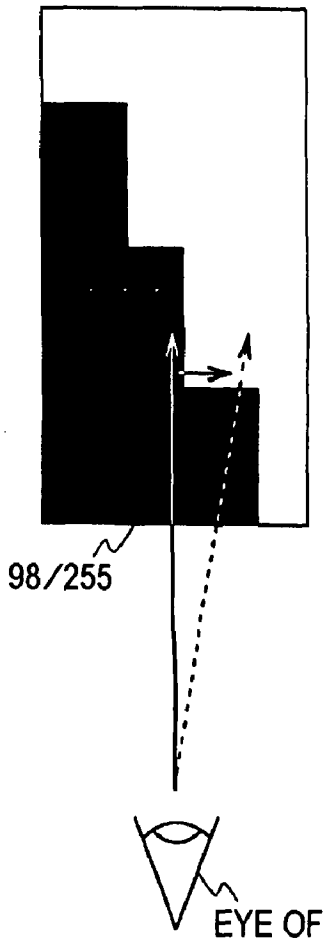

However, in the past FRC, setting the pixel value of each subframe to the displayable pixel value "I1" or "I2" before or after the pixel value "I0" of the halftone corresponding to the input video signal S1 and setting the occurrence rate of the pixel values "I1" and "I2" in the four subframes to a rate according to the pixel value "I0" of the halftone corresponding to the input video signal S1 cause the motion blur (refer to FIGS. 17 and 18).

In contrast, in the video signal processing apparatus 11 according to the first embodiment of the present invention (FIG. 1 and FIGS. 3 to 6), the maximum pixel value displayable in the display device 12 is sequentially set to the continuous subframes in the left justification, within the pixel value of the pixel corresponding to the input video signal S1, to set the pixel values for the subframes such that the maximum distribution of the pixel values in the time axis direction is yielded in order to reduce the motion blur.

Since the pixel values are set such that the maximum distribution of the pixel values in the time axis direction is yielded, the display characteristics in the display device 12 are approximated to the impulse response, thus reducing the motion blur. Consequently, according to the first embodiment of the present invention, it is possible to reduce the motion blur when one frame is displayed by using the multiple subframes to represent the halftones by the FRC.

Particularly, since the pixel values are set in the left justification, an enlargement of the outline of a moving object in the moving direction of the moving object when a human being follows the moving object with his eye can be suppressed if the pixel corresponding to the input video signal S1 has smaller value, as shown in FIG. 5 in contrast to FIG. 18. As a result, it is possible to remarkably reduce the motion blur particularly in darker areas in the first embodiment of the present invention.

However, when the pixel values are set such that the maximum distribution of the pixel values in the time axis direction is yielded, the image is displayed with only some subframes among the multiple subframes. As a result, a flicker possibly occurs.

According to the first embodiment of the present invention, since the input video signal S1 having a frame frequency of 60 Hz, which makes the flicker invisible, is received and the four subframes are set for one frame of the input video signal S1, it is possible to set the frequency for turning on the pixels of the subframes to 60 Hz at minimum even when the pixel values are set such that the maximum distribution of the pixel values in the time axis direction is yielded. In the setting of the frame frequency of the input video signal S1, practically sufficient characteristics can be yielded with the frame frequency being set to not less than 48 Hz. In addition, since the frame frequency of the output video signal S2 is set to 240 Hz, it is possible to set a period during which the pixel are not turned on to 12.5 msec ($=\frac{3}{4}\times\frac{1}{240}$) even when the pixel is turned on in a lower luminance with only one subframe among the continuous four subframes. It is said in a technical document that a critical period of presentation during which the Bloch's law is established is around 25 msec in a brighter background, so that an occurrence of the flicker can be sufficiently suppressed.

Consequently, according to the first embodiment of the present invention, it is possible to effectively avoid an occurrence of the flicker and to reduce the motion blur when one frame is displayed by using the multiple subframes to represent the halftones by the FRC.

Advantage

With the structure described above, setting the pixel values for the subframes such that the maximum distribution of the pixel values in the time axis direction is yielded allows the motion blur to be reduced when one frame is displayed by using the multiple subframes to represent the halftones by the FRC.

Specifically, it is possible to reduce the motion blur when one frame is displayed by using the multiple subframes to represent the halftones by the FRC, by setting the subframe rising to the maximum displayable pixel value, among the multiple subframes corresponding to one frame of the input video signal S1, so as to shift from the first subframe to the last subframe in accordance with the pixel value of the input video signal S1 to set the pixel values for the subframes such that the maximum distribution of the pixel values in the time axis direction is yielded.

Second Embodiment

It is proved that, depending on the pixel value set according to the first embodiment, the hue of the subframe is slightly varied from the hue of the input video signal S1 when the ratio of the RGB values is varied in the subframe to cause color breaking. Accordingly, according to a second embodiment of the present invention, the pixel values are set for the subframes such that the maximum distribution of the pixel values in the time axis direction is yielded under a condition for minimizing a difference in the hue between the input video signal S1 and the subframe. Since the video signal processing apparatus according to the second embodiment is structured and operates in the same manner as the video signal processing apparatus according to the first embodiment except for a process of setting the pixel value, the structure shown in FIG. 2 is used to describe the second embodiment of the present invention.

The pixel values of the subframe and the input video signal S1 are represented by the use of the pixel vectors described above. Specifically, a pixel value $d_i$ (x,y) of the subframe and a pixel value $f_0$ (x,y) of the input video signal S1 are calculated according to Expression (2) where k denotes a pixel vector coefficient of the i-th subframe.

[Formula 2]

$$d_i(x, y) = k_i f_0(x, y) \tag{2}$$

$$f_0(x, y) = \sum_{i=1}^{N} d_i(x, y)$$

The subframe generator 14 restricts a maximum displayable pixel value for every element with a maximum pixel vector coefficient $K_{max}$ which is the maximum value of the pixel vector coefficient, such that the ratio of the RGB values in the input video signal S1 is maintained. In other words, the subframe generator 14 sets the condition such that the difference in the hue between the input video signal S1 and the subframe is minimized to set the pixel value for the subframe under this condition.

The subframe generator 14 first calculates the maximum pixel vector coefficient $k_{max}$, which is the maximum value of the pixel vector coefficient. Under the condition that the hue is not varied from that of the input video signal S1, a maximum pixel value $d_{max}$ (x,y) which can be represented by one subframe at the coordinate (x,y) is expressed by Expression (3).

[Formula 3]

$$d_{max}(x,y)=K_{max}f_0(x,y) \tag{3}$$

Accordingly, maximum values $d_{max,r}$ (x,y), $d_{max,g}$ (x,y), and $d_{max,b}$ (x,y) of the elements, which can be represented by one subframe, are expressed by the following expressions.

[Formula 4]

$$d_{max,r}(x,y) \leqq 2^m - 1$$

$$d_{max,g}(x,y) \leqq 2^m - 1$$

$$d_{max,b}(x,y) \leqq 2^m - 1 \tag{4}$$

The following relational expressions are yielded from Expressions (3) and (4).

[Formula 5]

$$k_{max} \leq \frac{2^m - 1}{f_{0,r}(x, y)} \tag{5}$$

$$k_{max} \leq \frac{2^m - 1}{f_{0,g}(x, y)}$$

$$k_{max} \leq \frac{2^m - 1}{f_{0,b}(x, y)}$$

In order to establish the above relational expressions for all the elements, it is necessary to establish the following relational expression, where max (x,y,z) denotes a function returning the maximum values of x, y, and z.

[Formula 6]

$$k_{max} = \frac{2^m - 1}{\max(f_{0,r}(x, y), f_{0,g}(x, y), f_{0,b}(x, y))} \tag{6}$$

The maximum pixel vector coefficient $k_{max}$, yielded in the manner described above, is used to calculate the maximum pixel value $d_{max}$ (x,y) of the input video signal S1 according to Expression (3), and the following relational expression is used to calculate the pixel value of each element.

[Formula 7]

$$d_i(x, y) = \begin{cases} d_{max}(x, y) & (i+1)d_{max}(x, y) \leq f_0(x, y) \\ f_0(x, y) - id_{max}(x, y) & id_{max}(x, y) \leq f_0(x, y) < (i+1)d_{max}(x, y) \\ 0 & f_0(x, y) < id_{max}(x, y) \end{cases} \tag{7}$$

Figure 7:
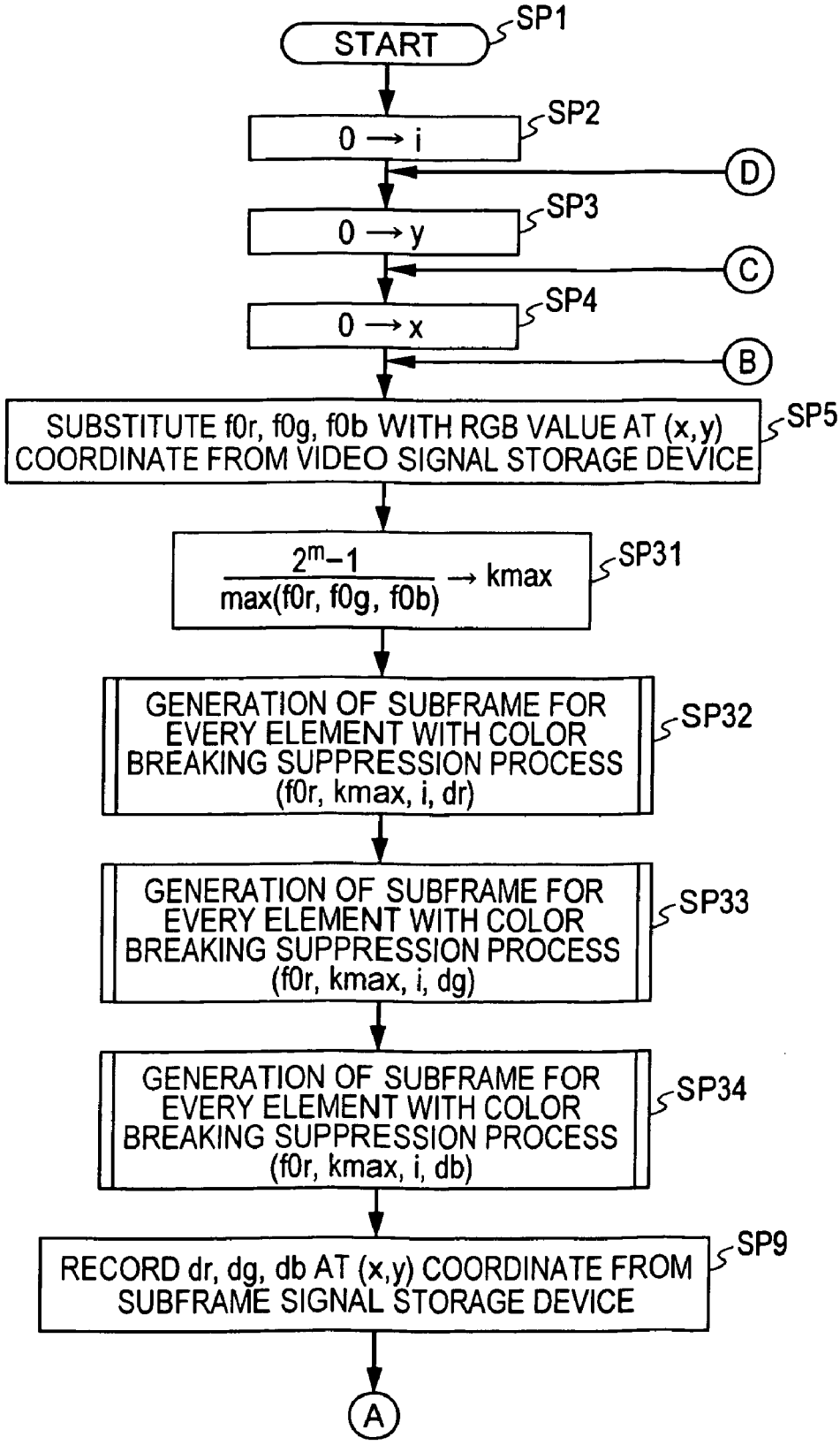
FIG. 7 is a flowchart showing a process in a subframe generator in a video signal processing apparatus according to a second embodiment of the present invention.
Figure 8:
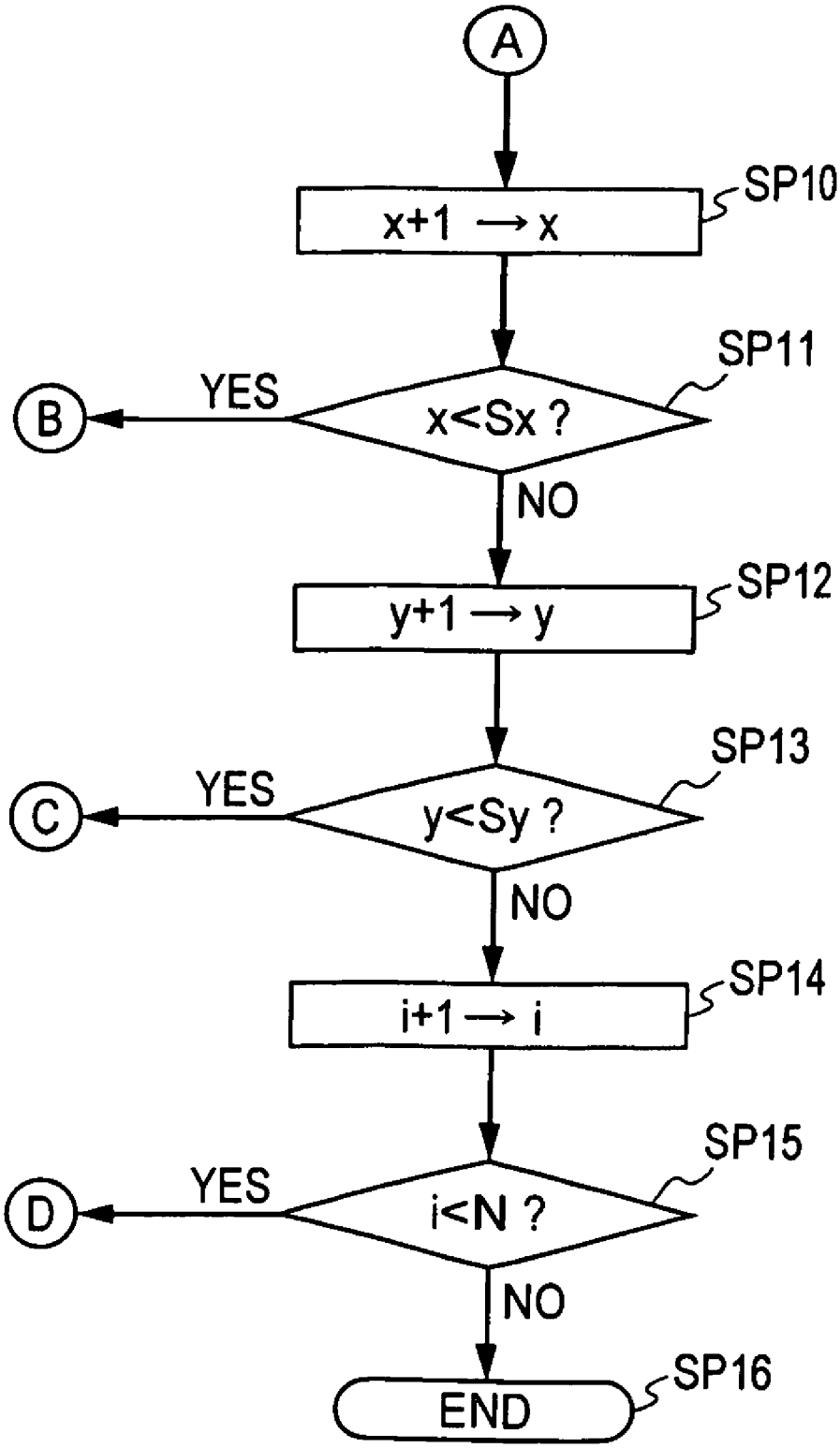
FIG. 8 is a flowchart continuing the flowchart in FIG. 7.

FIGS. 7 and 8 show a flowchart showing a process in the subframe generator 14, according to the second embodiment of the present invention, in contrast to FIGS. 3 and 4. The same step numbers are used in FIGS. 7 and 8 to identify the step numbers shown in FIGS. 3 and 4 and a description of such step numbers is omitted herein.

The subframe generator 14 sets the pixel value for every element in the order of the raster scanning, records the output video signal S2 displayed by using the subframes in the subframe signal storage device 15, and switches the subframe to be processed. In Step SP31, the subframe generator 14 calculates the maximum pixel vector coefficient $k_{max}$. In Steps SP32, SP33, and SP34, the subframe generator 14 uses the maximum pixel vector coefficient $k_{max}$ to set the pixel value of each element.

Figure 9:
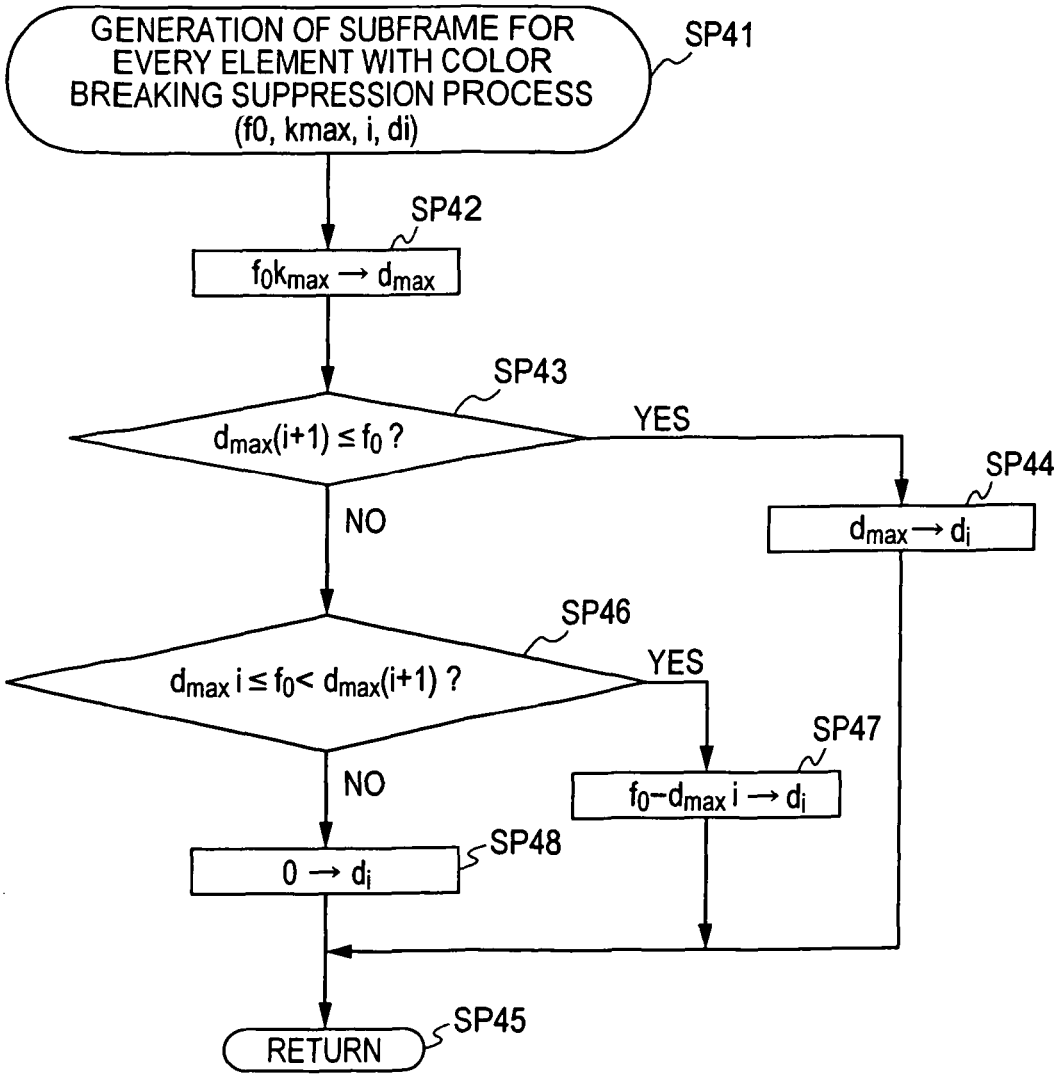
FIG. 9 is a flowchart showing in detail a subprocess of setting the pixel value in the process shown in FIGS. 7 and 8.

FIG. 9 is a flowchart showing a subprocess of setting the pixel value, performed in Steps SP32, SP33, and SP34, in contrast to FIG. 6. The subframe generator 14 performs the subprocess in FIG. 9 in each of Steps SP32, SP33, and SP34 described above with reference to FIGS. 7 and 8.

In Step SP41, the subframe generator 14 starts the process. In Step SP42, the subframe generator 14 performs the arithmetic processing in Expression (3) by using the maximum pixel vector coefficient $k_{max}$ calculated in Step SP31 to calculate the maximum pixel value $d_{max}$ (x,y) that can be set for the element to be processed under the condition that the hue of the subframe is not varied from that of the input video signal S1. In Step SP43, the subframe generator 14 determines whether a relational expression $d_{max}(i+1) \leqq f_0$ is established for the element to be processed. Specifically, when the maximum pixel value $d_{max}$ (x,y) that can be set for the element to be processed is set under the condition that the hue of the subframe is not varied from that of the input video signal S1, the subframe generator 14 determines whether the sum of the pixel values set for the subframes exceeds the pixel value $f_0$ of the pixel corresponding to the input video signal S1.

If the above relational expression is established in Step SP43, then in Step SP44, the subframe generator 14 sets the maximum displayable pixel value $d_{max}$ to the pixel value of the i-th subframe and, in Step SP45, the subframe generator 14 terminates the process.

If the above relational expression is not established in Step SP43, then in Step SP44, the subframe generator 14 determines whether a relational expression $d_{max}i \leqq f_0 < d_{max}(i+1)$ is established. Specifically, the subframe generator 14 determines whether the sum of the pixel values set for the subframes does not exceed the pixel value $f_0$ of the pixel corresponding to the input video signal S1 when the pixel values of the preceding subframes are set to the maximum displayable pixel value $d_{max}$ and whether the sum of the pixel values set for the subframes exceeds the pixel value $f_0$ of the pixel corresponding to the input video signal S1 when the pixel values of the subframe identified by the variable i and of the subframes preceding the subframe identified by the variable i are set to the maximum displayable pixel value $d_{max}$.

If the above relational expression is established in Step SP46, then in Step SP47, the subframe generator 14 sets the pixel values remaining after the pixel values of the preceding subframes are set to the maximum displayable pixel value $d_{max}$ to the pixel value of the i-th subframe and, in Step SP45, the subframe generator 14 terminates the process.

If the above relational expression is not established in Step SP46, then in Step SP48, the subframe generator 14 sets the pixel value of the subframe to zero and, in Step SP45, the subframe generator 14 terminates the process.

FIG. 10 is a table showing the calculation results of the first and second embodiments when smaller pixel values are set. The calculation results in the RGB system and representations in an HSV system are shown in FIG. 10. The representations in the HSV system are converted from the calculation results in the RGB system according to Expressions (8) and (9).

[Formula 8]

$$\begin{aligned} c_{max} &= \max(R, G, B) \\ c_{min} &= \min(R, G, B) \\ V &= c_{max} \\ S &= \frac{c_{max} - c_{min}}{c_{max}} \text{(where } S = 0 \text{ if } c_{max} = 0) \end{aligned} \tag{8}$$

[Formula 9]

-continued $$H = \begin{cases} \frac{\pi}{3}\left(\frac{G-B}{c_{max}-c_{min}}\right) & (\text{if } c_{max} = R) \\ \frac{\pi}{3}\left(2 + \frac{B-R}{c_{max}-c_{min}}\right) & (\text{if } c_{max} = G) \\ \frac{\pi}{3}\left(4 + \frac{R-G}{c_{max}-c_{min}}\right) & (\text{if } c_{max} = B) \end{cases} \tag{9}$$

where "2π" is added to "H" if H<0, and H=0 if S=0.

Figure 11B:
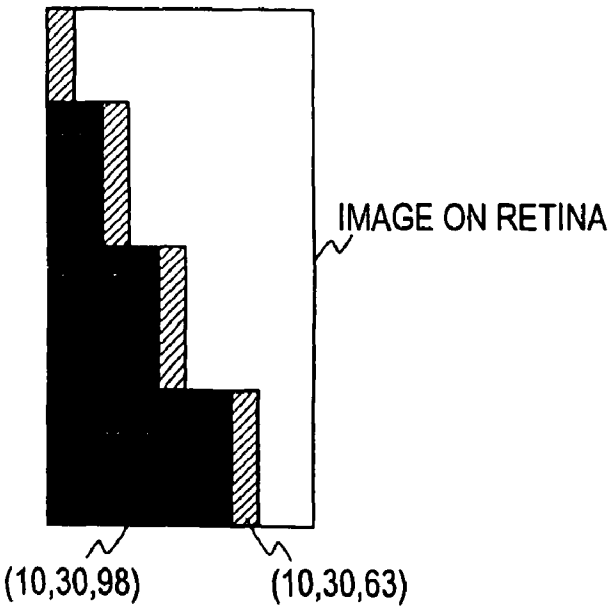
FIGS. 11A and 11B illustrate a variation in hue in the process according to the first embodiment of the present invention.
Figure 11A:
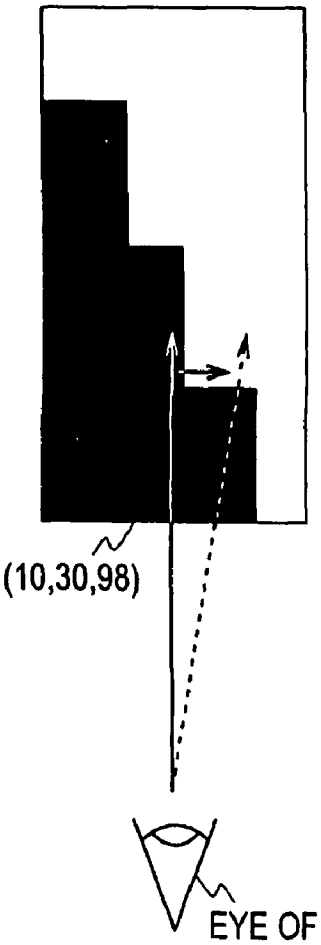
Figure 12A:
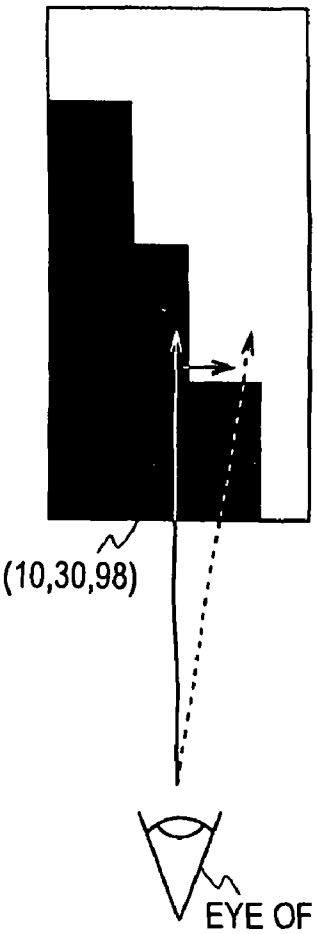
FIGS. 12A and 12B illustrate a variation in the hue in the process according to the second embodiment of the present invention, in contrast to FIGS. 11A and 11B.
Figure 12B:
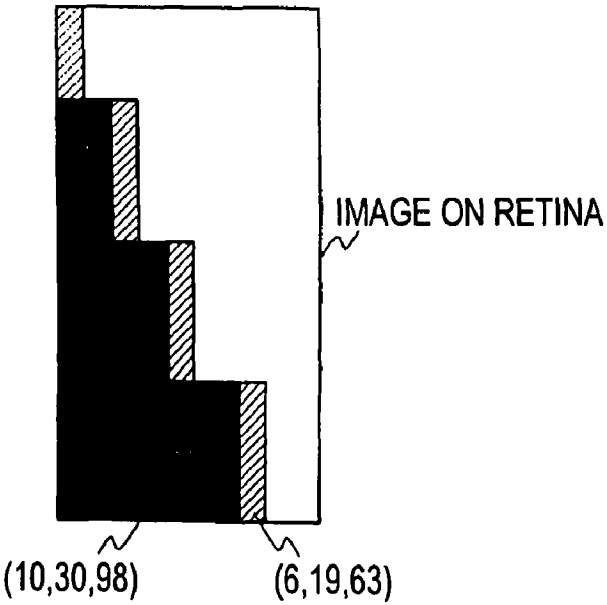

As shown in FIG. 10 and in FIGS. 11 and 12 in contrast to FIG. 18, the hue is varied in the images of an moving object on the retina, the images corresponding to the subframes, to cause the color breaking on the edge of the moving object in the process according to the first embodiment, whereas the color breaking can be sufficiently suppressed in the process according to the second embodiment.

According to the second embodiment of the present invention, setting the pixel values for the subframes such that the maximum distribution of the pixel values in the time axis direction is yielded under the condition that the hue is not varied in the multiple subframes corresponding to one frame of the input video signal S1 allows the color breaking to be suppressed to reduce the motion blur.

Other Embodiments

Figures 13A, 13B:
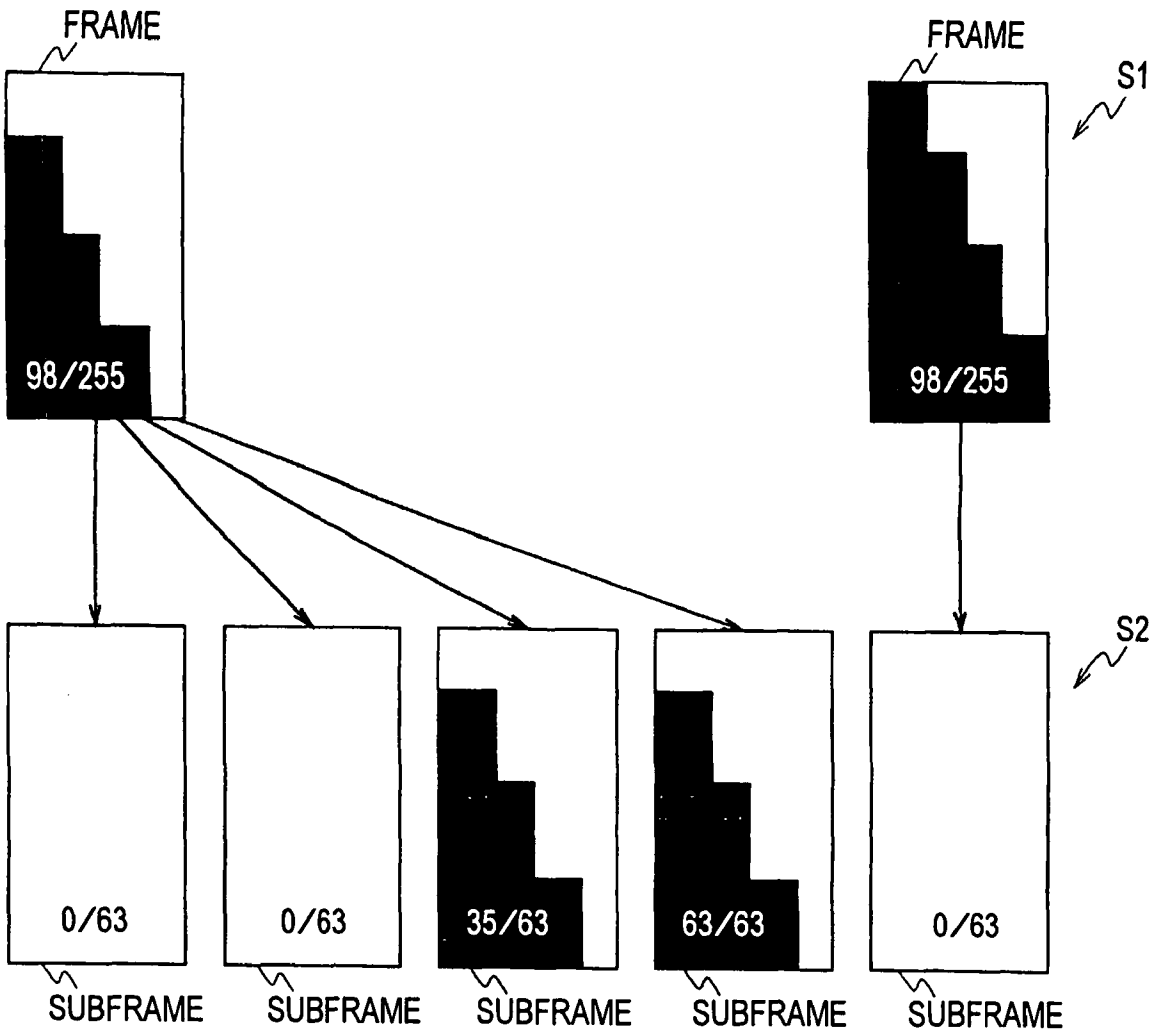
FIGS. 13A and 13B illustrate a process in a subframe generator in a video signal processing apparatus according to another embodiment of the present invention.
Figures 15A, 15B:
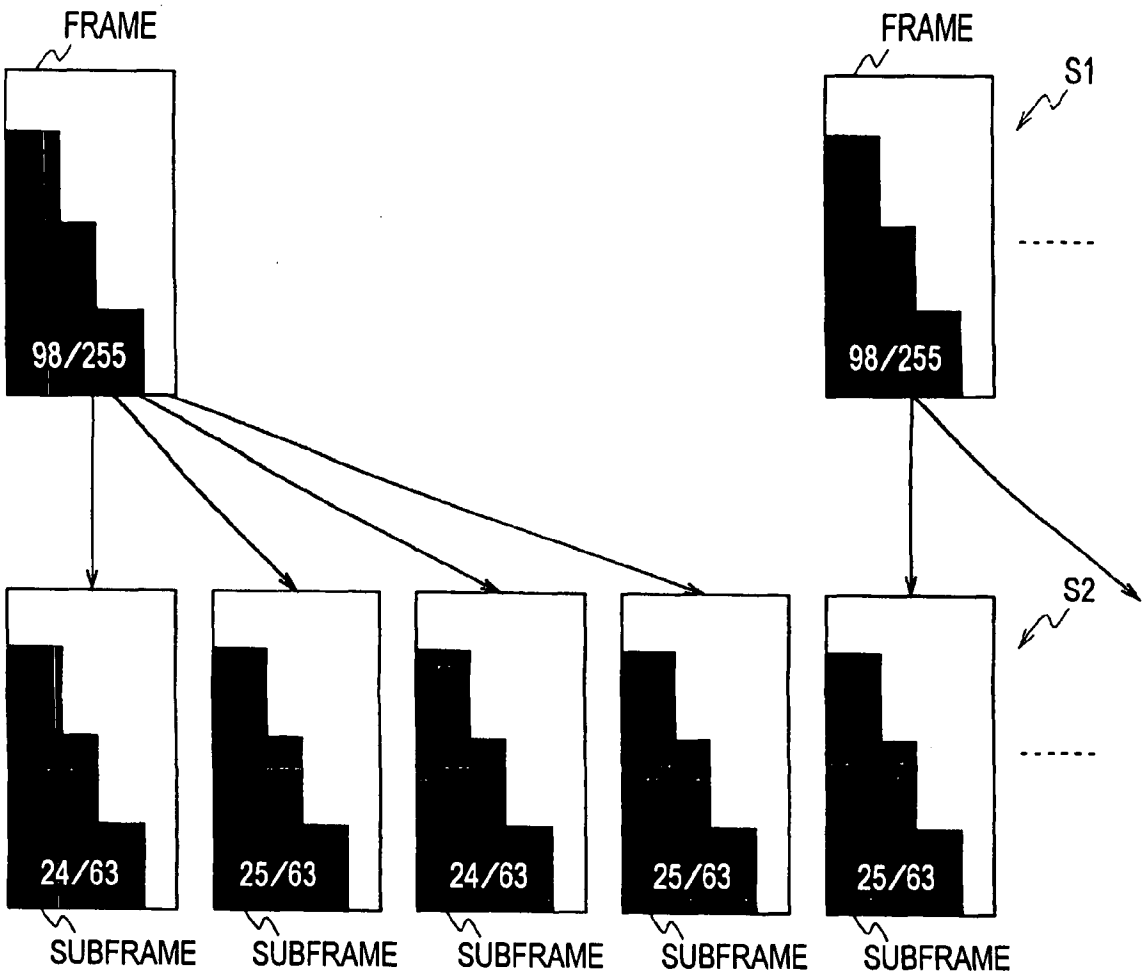
FIGS. 15A and 15B illustrate a case when one frame is displayed by using multiple subframes.
Figure 16:
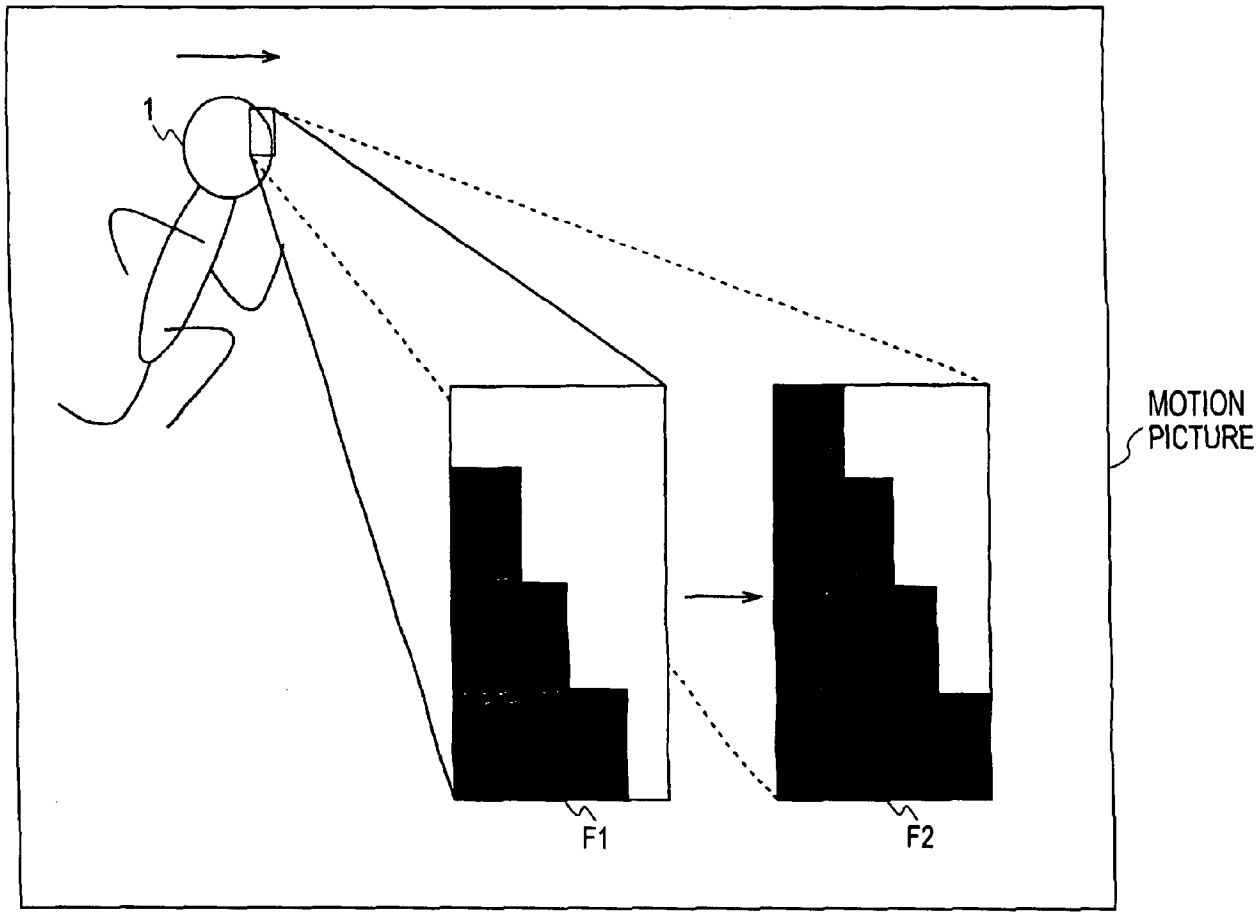
FIG. 16 illustrates a movement of an edge in a motion picture.

Although the pixel values are set in the left justification in the embodiments described above, the present invention is not limited to the left justification. As shown in FIG. 13 in contrast to FIG. 1, the pixel values may be set in right justification or the process may switch between the left justification and the right justification to set the pixel values.

Although the pixel values are set such that the maximum distribution of the pixel values in the time axis direction is yielded in the embodiments described above, the present invention is not limited to this case. Switching between the process of setting the pixel values such that the maximum distribution of the pixel values in the time axis direction is yielded and a process of setting the pixel values in a related art may be performed. In such a case, for example, the pixel values are set such that the maximum distribution of the pixel values in the time axis direction is yielded only in the motion pictures detected by motion detection, and the pixel values are set by the method in the related art in the still pictures.

Although the output video signal having a frame frequency of 240 Hz is generated from the input video signal having a frame frequency of 60 Hz in the embodiments described above, the present invention is not limited to these values. The present invention is applicable to various cases including cases where the output video signal having a frame frequency of 120 Hz is generated from the input video signal having a frame frequency of 60 Hz, where the output video signals having frame frequencies of 100 Hz and 200 Hz are generated from the input video signal having a frame frequency of 50 Hz in Phase Alternation by Line (PAL) format, and where the input video signal having a frame frequency of 48 Hz in Telecine is processed. Application of the present invention to the processing of the input video signal in an existing television format allows an existing content to be displayed with a high quality even when the content is displayed in a display device having a smaller number of tones.

Although the video signal including the chrominance signals is processed in the embodiments described above, the present invention is not limited to this case. The present invention is applicable to processing of the video signal including luminance and color difference signals.

It should be understood by those skilled in the art that various modifications, combinations, sub-combinations and alterations may occur depending on design requirements and other factors insofar as they are within the scope of the appended claims or the equivalents thereof.

The invention claimed is:

1. A video signal processing apparatus, comprising:

a video signal storage unit operable to store an input video signal having a frame frequency and a number of tones; and a generating unit operable to generate a plurality of subframes from each frame of the input video signal to generate an output video signal having a frame frequency higher than the frame frequency of the input video signal and a number of tones less than the number of tones of the input video signal, wherein the pixel values of pixels corresponding to the plurality of subframes are set in accordance with the input video signal to represent halftones that are difficult to display with the number of the tones of the output video signal, and the pixel values of the pixels corresponding to the plurality of subframes are set to yield a maximum distribution of the pixel values in a time axis direction such that among the plurality of subframes corresponding to one frame of the input video signal, a respective subframe rising to a maximum pixel value displayable with the output video signal is set so as to shift from a first subframe to a last subframe in accordance with the pixel value of the input video signal.

2. The video signal processing apparatus according to claim 1, wherein the pixel values are set so that hue is not varied in the plurality of subframes corresponding to one frame of the input video signal.

3. The video signal processing apparatus according to claim 1, further comprising a display for displaying the output video signal.

4. The video signal processing apparatus according to claim 1, wherein the frame frequency of the input video signal is 60 Hz, and the frame frequency of the output video signal is 120 Hz.

5. The video signal processing apparatus according to claim 1, wherein the frame frequency of the input video signal is 60 Hz, and the frame frequency of the output video signal is 240 Hz.

6. The video signal processing apparatus according to claim 1, wherein the frame frequency of the input video signal is 50 Hz, and the frame frequency of the output video signal is 100 Hz.

7. The video signal processing apparatus according to claim 1, wherein the frame frequency of the input video signal is 50 Hz, and the frame frequency of the output video signal is 200 Hz.

8. A video signal processing method, comprising:

receiving an input video signal having a frame frequency and a number of tones;

generating a plurality of subframes from each frame of the input video signal to generate an output video signal having a frame frequency higher than the frame frequency of the input video signal and a number of tones less than the number of tones of the input video signal; and setting the pixel values of pixels corresponding to the plurality of subframes in accordance with the input video signal to represent halftones that are difficult to display with the number of the tones of the output video signal, wherein the pixel values of the pixels corresponding to the plurality of subframes are set to yield a maximum distribution of the pixel values in a time axis direction such that among the plurality of subframes corresponding to one frame of the input video signal, a respective subframe rising to a maximum pixel value displayable with the output video signal is set so as to shift from a first subframe to a last subframe in accordance with the pixel value of the input video signal.

9. A video signal processing program that causes an arithmetic processor to perform a predetermined process, the process comprising:

receiving an input video signal having a frame frequency and a number of tones;

generating a plurality of subframes from each frame of the input video signal to generate an output video signal having a frame frequency higher than the frame frequency of the input video signal and a number of tones less than the number of tones of the input video signal; and setting the pixel values of pixels corresponding to the plurality of subframes in accordance with the input video signal to represent halftones that are difficult to display with the number of the tones of the output video signal, wherein the pixel values of the pixels corresponding to the plurality of subframes are set to yield a maximum distribution of the pixel values in a time axis direction such that among the plurality of subframes corresponding to one frame of the input video signal, a respective subframe rising to a maximum pixel value displayable with the output video signal is set so as to shift from a first subframe to a last subframe in accordance with the pixel value of the input video signal.

10. A non-transitory recording medium recorded with a video signal processing program that causes an arithmetic processor to perform a predetermined process, the process comprising:

receiving an input video signal having a frame frequency and a number of tones;

generating a plurality of subframes from each frame of the input video signal to generate an output video signal having a frame frequency higher than the frame frequency of the input video signal and a number of tones less than the number of tones of the input video signal; and setting the pixel values of pixels corresponding to the plurality of subframes in accordance with the input video signal to represent halftones that are difficult to display with the number of the tones of the output video signal, wherein the pixel values of the pixels corresponding to the plurality of subframes are set to yield a maximum distribution of the pixel values in a time axis direction such that among the plurality of subframes corresponding to one frame of the input video signal, a respective subframe rising to a maximum pixel value displayable with the output video signal is set so as to shift from a first subframe to a last subframe in accordance with the pixel value of the input video signal.

* * * * *